United States Patent [19]

Valencic et al.

[11] Patent Number: 4,709,471

[45] Date of Patent: Dec. 1, 1987

[54] METHOD OF MAKING A MAGNETIC CORE

[75] Inventors: Milan D. Valencic, Athens, Ga.; Dennis A. Schaffer, Dallas, N.C.

[73] Assignee: Westinghouse Electric Corp., Pittsburgh, Pa.

[21] Appl. No.: 896,781

[22] Filed: Aug. 15, 1986

[51] Int. Cl.[4] ..... H01F 41/06

[52] U.S. Cl. ..... 29/605; 29/601; 83/17; 83/54; 83/184; 83/649

[58] Field of Search ..... 29/605, 606, 609; 336/212, 216; 83/17, 19, 54, 649, 184, 178, 176

[56] References Cited

U.S. PATENT DOCUMENTS 3,160,044 12/1964 Somerville ..... 83/19

4,615,106 10/1986 Grimes et al. ..... 29/605

*Primary Examiner*—Carl E. Hall

*Attorney, Agent, or Firm*—D. R. Lackey

[57] ABSTRACT

A method of constructing a jointed magnetic core from amorphous metal, which includes winding a closed core loop having a plurality of nested lamination turns disposed about a core opening or window, and positioning the closed core loop on a support surface with the winding axis horizontally disposed, to allow the inherent flexibility of amorphous metal to collapse the loop opening and create a concave loop in the unsupported portion of the closed core loop. The method further includes the step of lifting a plurality of lamination turns from the concave loop portion, to provide a clearance between the raised lamination turns and the remaining lamination turns in the concave loop to facilitate cutting the lamination turns. A cutting device, which may be a laser or a mechanical cutter, cuts one or more of the raised lamination turns. The method then repeats the steps of raising and cutting lamination turns, with the core loop or the cutting device being indexed to stagger the cuts and create a predetermined stepped-lap joint pattern when the cut lamination turns are subsequently assembled into a closed core loop.

33 Claims, 23 Drawing Figures

FIG.1
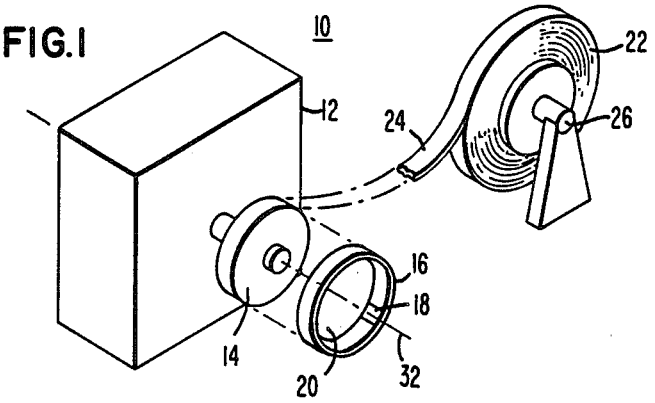
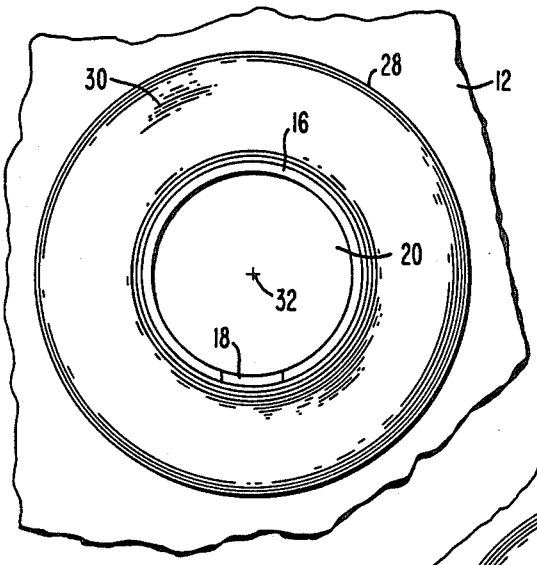
FIG.2
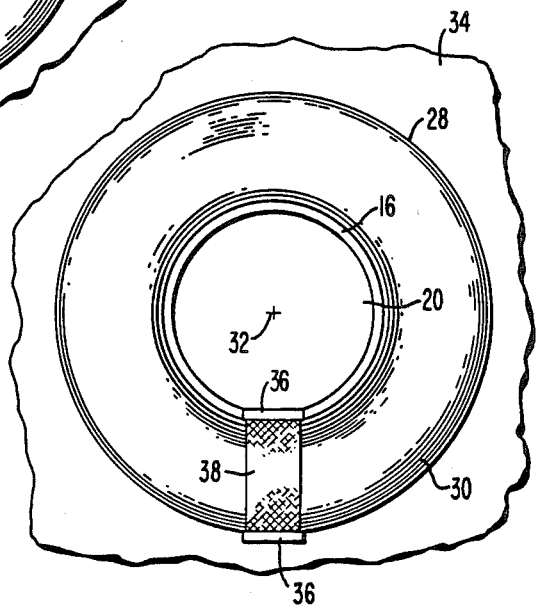
FIG.3

FIG.6
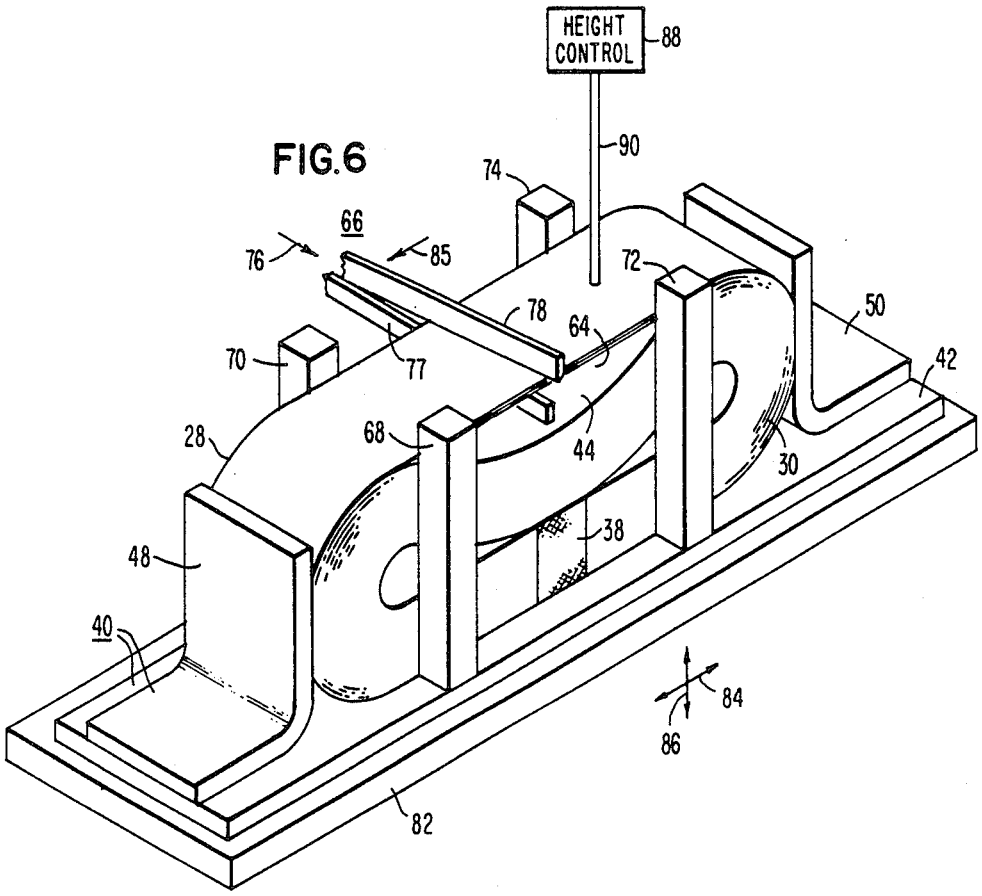
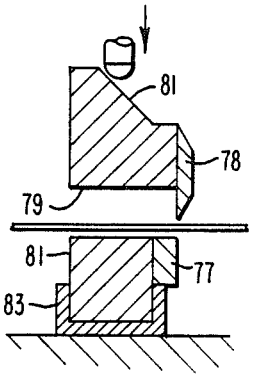
FIG.6A

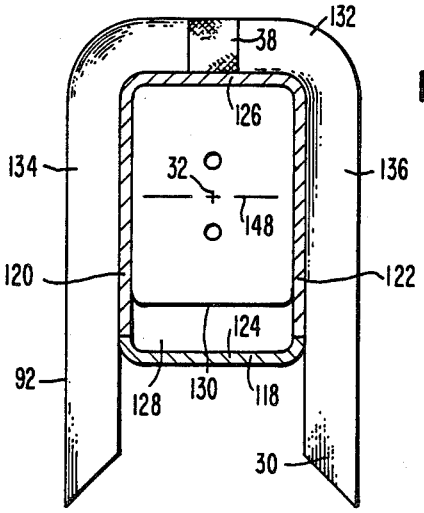
FIG.13
FIG.14
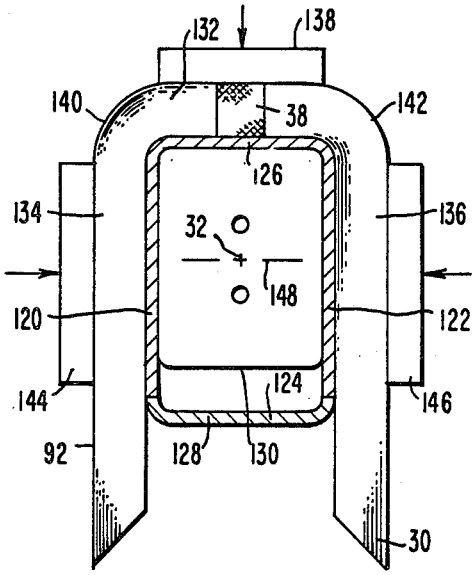
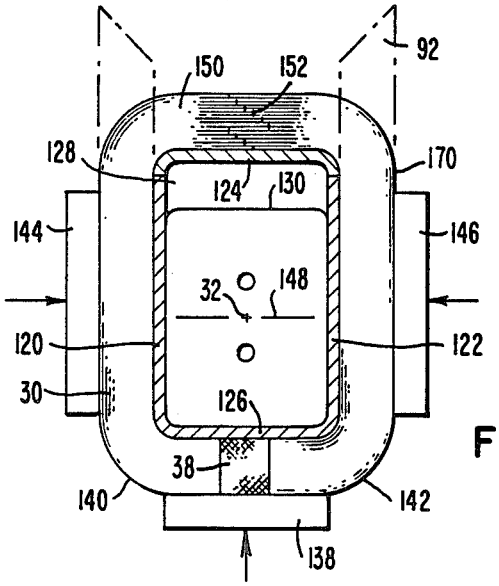
FIG.15

FIG.17
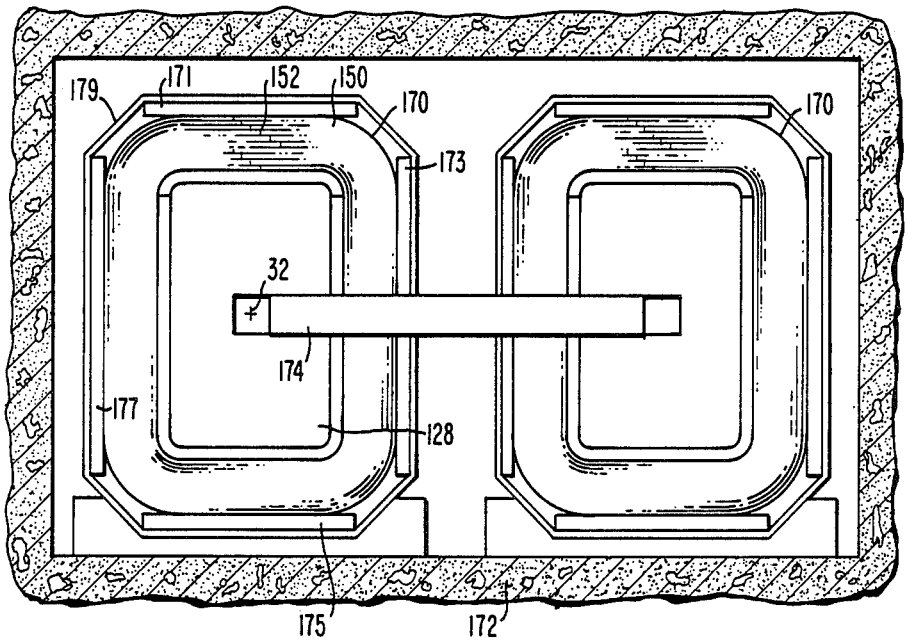
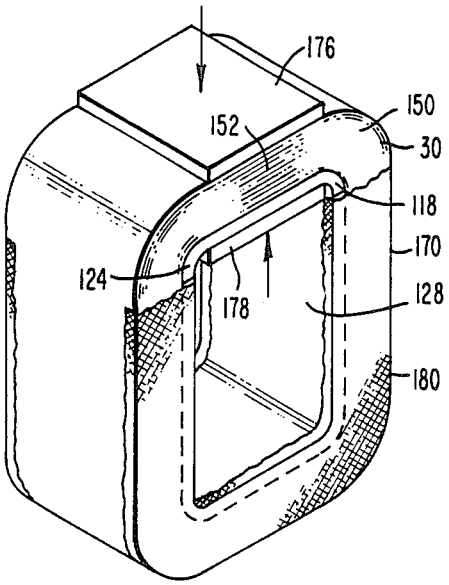
FIG.18

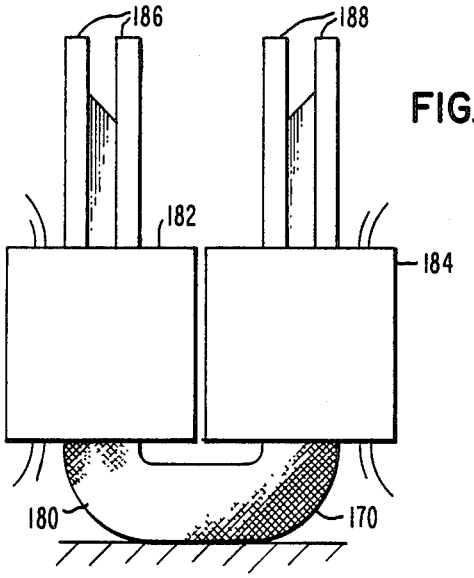
FIG.19
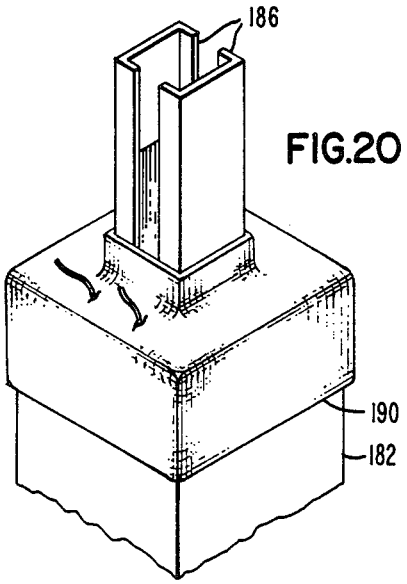
FIG.20
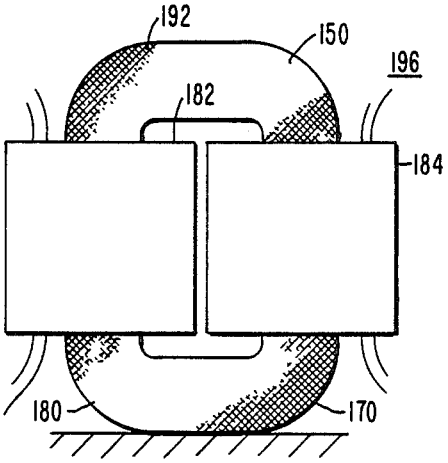
FIG.21
FIG.22
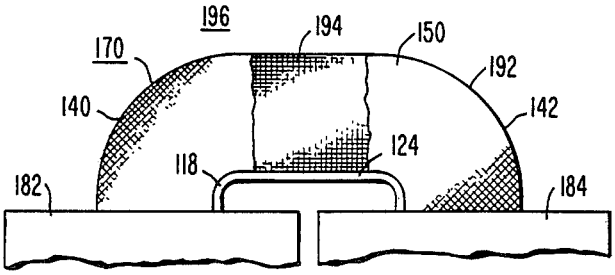

METHOD OF MAKING A MAGNETIC CORE

BACKGROUND OF THE INVENTION

1. Field of the Invention

The invention relates in general to magnetic cores and core-coil assemblies for electrical inductive apparatus, such as distribution transformers, and more specifically to new and improved methods of constructing such magnetic cores of amorphous metal.

2. Description of the Prior Art

Amorphous metal alloys, such as Allied Metglas Product's 2605SC and 2605S-2, exhibit a relatively low no-load loss when used in the magnetic core of an electrical transformer. Thus, the use of amorphous metal alloys appears to be an attractive alternative to conventional grain oriented electrical steel in the construction of magnetic cores for electrical distribution transformers. Although amorphous metal has a higher initial cost than conventional grain oriented electrial steel, the cost difference may be more than offset over the operating life of a transformer by the savings in energy which otherwise would have to be generated to supply the higher losses.

Amorphous metal alloy, however, cannot simply be substituted for conventional electrical steel in the transformer manufacturing process. Amorphous metals possess characteristics which create manufacturing problems which must be economically solved before production line transformers utilizing amorphous metal cores will be readily available in the market place.

For example, amorphous metal is very thin, having a nominal thickness of about 1 mil. Amorphous metal is also very brittle, especially after stress relief anneal, which anneal is necessary after a core is formed of amorphous metal, because amorphous metals are very stress sensitive. The no-load losses of amorphous metals increase significantly after being wound, or otherwise formed into the shape of a magnetic core suitable for distribution transformers. The low no-load loss characteristic is then restored by the stress-relief anneal.

The thin, brittle amorphous metal strip also makes the forming of the conventional core joint a different manufacturing problem. While the use of a jointless core solves the joint problem, it complicates the electrical windings. Conventional electrical windings, which are simply slipped over the core legs before the conventional core joint is closed, cannot be used with an unjointed core. Techniques are available for winding the high and low voltage windings directly on the legs of an uncut amorphous core, but, in general, these techniques add manufacturing cost and production line complexity.

Another characteristic of amorphous metal cores which creates manufacturing problems is the extreme flexibility of the core after it is wound. For example, a core wound of amorphous metal is not self supporting. When the mandrel upon which the core is wound is removed, the core will collapse from its own weight, if the winding axis is not maintained in a vertical orientation.

SUMMARY OF THE INVENTION

Briefly, the present invention is a new and improved method of constructing a magnetic core of amorphous metal, which method economically permits the use of a core joint, with all of the attendant manufacturing advantages the joint allows. The mew and improved method takes advantage of a characteristic of a wound amorphous core which is normally considered to be a disadvantage; the extreme flexibility of the core. After the core is wound from a strip of amorphous metal, the supporting mandrel is removed, the winding axis is disposed horizontally, and the core is placed on a support surface where it is allowed to collapse. The unsupported portion of the core forms a concave loop which is utilized to create space for a lamination cutting function. The lamination turns are raised from the concave loop and cut mechanically, or with a beam of electromagnetic radiation, such as a laser beam. If cut mechanically, a number of laminations may be raised, such as five, ten, or fifteen at a time, for example, and the raised lamination turns may be simultaneously cut. If cut with a laser beam, a single lamination turn is raised to the focal point of the laser beam and cut. After a predetermined number of lamination turns have been cut at a predetermined perimetrical location of the wound loop, the cutting location is changed by indexing either the cutting means or the magnetic core. The raising, cutting and indexing steps are then repeated until the complete core build has been cut, with the cut pattern enabling a low-loss stepped-lap joint to be formed when the cut lamination turns are subsequently assembled with separately wound high and low voltage windings.

In a preferred embodiment of the invention, either magnetic attraction or magnetic repulsion is used to raise or separate one or more of the outermost lamination turns from the concave loop.

If the cutting step uses mechanical means, such as a scissors or a shear action, the raising step preferably raises a group of lamination turns. Each time a group of lamination turns is raised away from the concave loop, a suitable cutting device is advanced into cutting position to select a predetermined number of lamination turns, and the selected raised lamination turns are simultaneously cut. The mechanical cutting device is then retracted to prevent interference with the next raising step. Either the core loop or the mechanical cutting device is indexed or "stepped" back and forth, in a direction perpendicular to the advancing and retracting movements, as required between cuts, to create the desired stepped-lap joint pattern.

If the cutting step is performed by laser beam, the magnetic field may raise a number of lamination turns, but only the outermost lamination turn is raised precisely to the laser focal point, determined by a mechanical stop. This lamination turn is then cut and the ends moved away from the cutting location to allow the next lamination turn to automatically position itself against the stop. After a predetermined number of lamination turns have been cut at a predetermined perimetrical location of the core loop, the laser beam may be indexed, such as with a mirror, or the core loop may be indexed, as desired, to locate the next step of the desired stepped pattern.

BRIEF DESCRIPTION OF THE DRAWINGS

The invention may be better understood and further advantages and uses thereof more readily apparent when considered in view of the following detailed description of exemplary embodiments, taken with the accompanying drawings, in which:

FIG. 1 is a perspective view illustrating apparatus which may be used in a first step of the method of constructing a magnetic core of amorphous metal according to the teachings of the invention;

FIG. 2 is an elevational view of a closed magnetic core loop wound with the apparatus shown in FIG. 1;

FIG. 3 is a plan view of the closed magnetic core loop shown in FIG. 2, after the winding mandrel has been removed, illustrating a step of clamping or fixing the lamination turns of the magnetic core at a predetermined perimetrical location of the wound core loop, such as by edge bonding;

FIG. 6 illustrates an alternative method of magnetically lifting the outermost lamination turns from the concave portion of the wound core loop, using magnetic repulsion to lift and fan apart a group of lamination turns;

FIG. 6A is a cross sectional view of a mechanical cutting device shown in FIG. 6, illustrating how zero clearance may be maintained between the blades of a cutting device which utilizes a scissors action;

FIG. 13 is an elevational view of the stack of cut lamination turns shown in FIG. 12, after the cut lamination turns are allowed to droop about the support fixture;

FIG. 14 is an elevational view of the stack of cut lamination turns shown in FIG. 13, illustrating the application of pressure to cause the lamination turns to be tightly pressed together, and against three sides of the rectangularly shaped support fixture;

FIG. 15 is an elevational view of the cut core loop and the support fixture shown in FIG. 14, after the cut core loop and fixture have been rotated 180 degrees about the horizontally oriented core winding axis, and a stepped-lap joint formed on the now upwardly facing portion of the core loop, to create the core configuration that the core will subsequently assume when assembled with high and low voltage windings;

FIG. 17 is an elevational view which illustrates the magnetic core shown in FIG. 15 being subjected to a stress-relief anneal cycle in an oven;

FIG. 18 is a perspective view which illustrates the magnetic core shown in FIG. 17, after the stress-relief anneal step, illustrating the consolidation of the lamination turns in all areas of the magnetic core loop, except the yoke portion which includes the core joint;

FIG. 19 is an elevational view of the consolidated magnetic core shown in FIG. 18, with the joint open and with coil assemblies in position about the leg portions of the magnetic core;

FIG. 20 is a fragmentary, perspective view of one of the electrical coil assemblies shown in FIG. 19, illustrating a step of the method which protects the coil assemblies from air borne foreign matter during subsequent manufacturing steps;

FIG. 21 is an elevational view of the magnetic core shown in FIG. 19, after the core joint has been closed and the turns of the jointed yoke portion of the core have been consolidated; and FIG. 22 is an enlarged elevational view of the yoke area of the magnetic core shown in FIG. 21, illustrating an alternative embodiment of the consolidating process.

DESCRIPTION OF THE PREFERRED EMBODIMENTS

Figure 4:
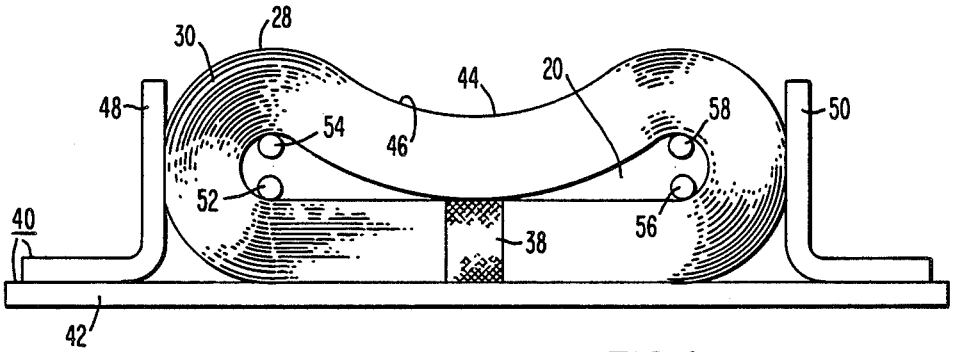
FIG. 4 is an elevational view of the magnetic core shown in FIG. 3, in a suitable support fixture, with the winding axis horizontally disposed, illustrating how the core collapses under its own weight and forms a concave loop in the unsupported portion of the core loop.

Referring now to the drawings, and to FIG. 1 in particular, there is shown a perspective view of apparatus 10 which may be used to perform the initial step of a new and improved method of constructing a magnetic core of amorphous metal alloy, according to the teachings of the invention. Apparatus 10 includes a winding machine 12 having a winding block or mandrel 14 which is rotated by the winding machine 12. In the preferred embodiment of the invention, the magnetic core is first wound in a round configuration, and thus the mandrel 14 has a round outer configuration. Mandrel 14 may be of the collapsible type, permitting the core material to be directly wound on the mandrel, or a winding arbor or tube 16 may be provided. If a winding tube 16 is used, it may be in the form of a round, cylindrical, tubular member having a removable piece 18 which may be removed after the winding step to provide a circumferential gap. Winding tube 16 will define a round core loop opening or window 20 after the tube 16 and the core loop wound thereon are removed from the winding machine mandrel 14.

A reel 22 which contains a continuous strip 24 of amorphous metal is mounted on a suitable payoff support 26 adjacent to the winding machine 12, such that strip 24 may be pulled from reel 22 with a controllable tension and wound about tube 16. FIG. 2 is a fragmentary elevational view of winding machine 12 after a continuous core loop 28 having a plurality of superposed or nested lamination turns 30 have been wound about a central winding axis 32.

Core loop 28 and winding tube 16 are then removed from the winding machine 12, after the desired number of lamination turns 30 have been formed to complete the core build dimension about opening or core window 20.

The next step of the method is shown in FIG. 3, with FIG. 3 being a plan view of core loop 28 as it rests upon a flat, horizontally oriented support surface 34. In this step, the lamination turns 30 are held together at a predetermined perimetrical location of the core loop 28, such that the lamination turns 30 may be subsequently cut while retaining the as-wound positional relationship of the lamination turns. As illustrated in the Figures, this positional fixing of the lamination turns may be accomplished by removing piece 18 from the winding tube 16 after the core loop 28 is supported by support surface 34, to provide space for a temporary clamp 36 to be placed across the core build. While so clamped, a narrow band 36 of a suitable adhesive, such as padding glue, is applied across the adjacent edges of the lamination turns 30. While a band 36 on one axial end of the loop is usually sufficient, a similar band may be placed at the same circumferential location on the other axial end of the core loop 28. Instead of adhesive bonding, the mechanical clamp 36 may be used, if it does not interfere with the subsequent steps of the method, to be hereinafter described. After the lamination turns have been positionally fixed, the winding tube 16 is removed from the loop window 20.

The next step, illustrated in the elevational view of core loop 28 in FIG. 4, involves reorienting the core loop 28 in a suitable support fixture 40 which includes a support plate 42, such that the now internally unsupported core loop 28 has its winding axis 32 horizontally disposed, with the band 38 of adhesive, or other suitable clamping means, being centered in the portion of the core loop 28 which is directly supported by support plate 42.

Core loop 28 is not self supporting in this orientation, with the unsupported portion of the core loop 28 collapsing to reconfigure the core window 20 and create a concave portion 44 in the upwardly facing outer surface 46 of core loop 28. Spaced stops 48 and 50, and pins 52, 54, 56 and 58 may be provided to aid in locating and holding the core loop 28. This extreme flexibility of core loop 28 is normally a manufacturing disadvantage, requiring positive manufacturing steps to prevent collapse of the core loop from occurring. The present invention takes advantage of this core flexibility to provide a new and improved method of constructing a jointed amorphous core.

Figure 5:
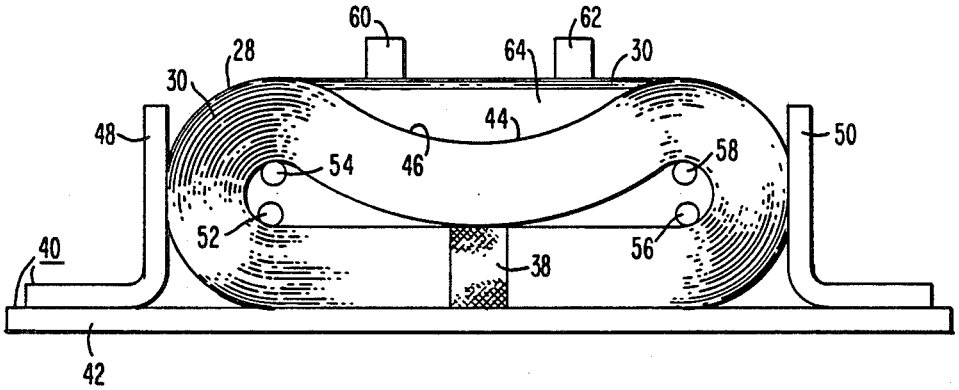
FIG. 5 illustrates magnetically lifting, by magnetic attraction, a predetermined group of the outermost lamination turns, from the concave portion of the wound core loop.

More specifically, the concave loop 44 is used to provide space for separating and then cutting the lamination turns 30. A predetermined number of the lamination turns 30, eg., from one to fifteen, for example, which are located immediately adjacent to the outer surface 46 of the concave loop 44, is raised or lifted away from the remaining lamination turns 30 of the concave loop. This provides room for positioning a mechanical cutting device to cut the raised laminations. Alternatively, it separates the lamination turns to allow a single lamination turn to be raised or lifted to the focal point of a laser cutting beam, for cutting the sheet without adversely affecting adjacent uncut lamination turns. In a mechanical cutting embodiment of the invention, a group of lamination turns is magnetically separated from the remainder of the lamination turns 30. FIG. 5 is an elevational view of core loop 28, with the outermost lamination turns 30 being lifted according to an embodiment of the invention which utilizes the principles of magnetic attraction. One or more magnets, such as magnets 60 and 62, for example, which magnets may be permanent magnets or electromagnets, are selected to have a predetermined strength. The magnets are positioned to magnetically attract and raise the desired number of lamination turns 30, to substantially the horizontal orientation shown in FIG. 5. This creates a space 64 between the lifted lamination turns 30 and the concave surface 44, enabling a lamination cutting device to be advanced into cutting position above and below the lifted lamination turns 30.

FIG. 6 is a perspective view of core loop 28 illustrating another magnetic embodiment for performing the function of raising a group of lamination turns 30 from the concave portion 44 of the core loop 28. In this embodiment, magnetic repulsion is used to raise and fan apart a group of lamination turns 30, with all lamination turns 30 which are lifted above the level of a mechanical cutting device 66 being selected for simultaneous cutting. The magnetic lifting and fanning of a selected group of lamination turns 30 may be accomplished, for example, by first and second pairs of bar magnets, which are placed adjacent to opposite axial ends of the magnetic core loop 28, with the first pair including magnets 68 and 70, and with the second pair including magnets 72 and 74. The upper ends of the magnets are selected to be like poles, ie., north poles, or south poles.

Figure 7:
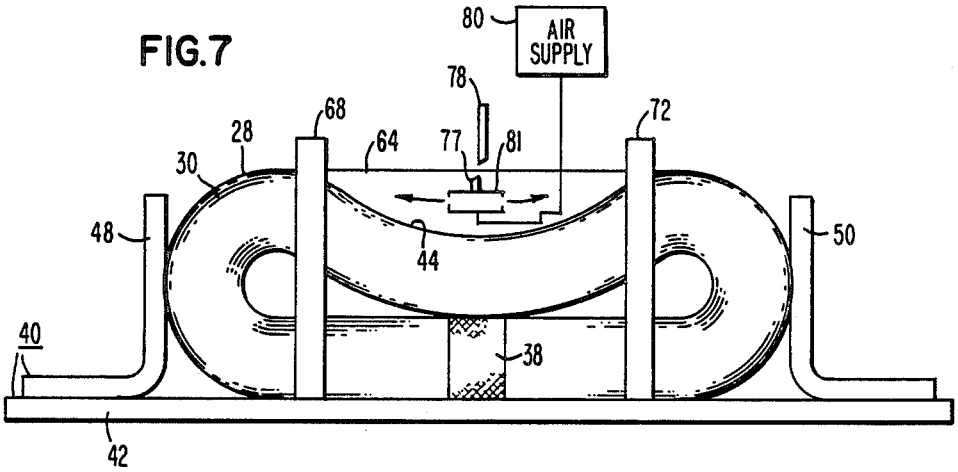
FIG. 7 is an elevational view of the magnetic core shown in either FIG. 5 or 6, illustrating a mechanical cutting embodiment, including the step of advancing a cutting device into position to simultaneously cut a group of the lamination turns which was raised or lifted from the concave core loop by the prior step.

As shown in FIG. 6 and in the elevational view of core loop 28 in FIG. 7, the mechanical cutting device 66 may be advanced in a direction parallel to the core winding axis 32, as indicated by arrow 76, into a lamination cutting position, after the step of raising a group of lamination turns 30. Cutting device 66, which may have a shear, or a scissors action, for example, includes a first portion which includes a blade 77. The blade 77 is advanced into space 64. Cutting device 65 also includes a second portion having a blade 78 which is located above the first portion, and positioned above the lifted lamination turns 30.

FIG. 6A is a cross sectional view of blades 77 and 78, which are shown associated with blade holders 81 and 79, respectively. Zero clearance between blades 77 and 78 is maintained in a preferred scissors cutting embodiment of the invention by maintaining blades 77 and 78 in contact with one another at the pivotable end of the scissors arrangement, as shown in FIG. 6, such as with a spring loaded thrust bearing. Arrow 85 in FIG. 6 indicates the continuous bias of the pivotable blade 78 against the fixed blade 77. The bottom blade holder 81, when advanced into cutting position, enters a fixed guide member 83. The upper blade holder 79 includes a sloped surface 81 near its unsupported end, which surface is contacted by the scissors actuator 83, such as an air cylinder. The slope is selected such that the resulting arrangement biases the outer end of the pivotable upper blade 78 against the lower blade 77, assuring clean cuts or breaks of the hard, brittle amorphous steel, even when a plurality of lamination turns are cut at a time.

All of the lifted or raised lamination turns 30 which are located between blades 77 and 78 of the cutting device 66 are simultaneously cut. The cut lamination turns are moved out of the way, such as by magnetic attraction via permanent or electromagnets, to provide a stack of cut lamination turns, positionally related by band 38 of adhesive. Alternatively, the cut lamination turns may be moved out of the way by providing a supply 80 of air, as illustrated, with the air being timely directed through suitable apertures in blade holder 81 of the first portion of the cutting device 66.

Figure 8:
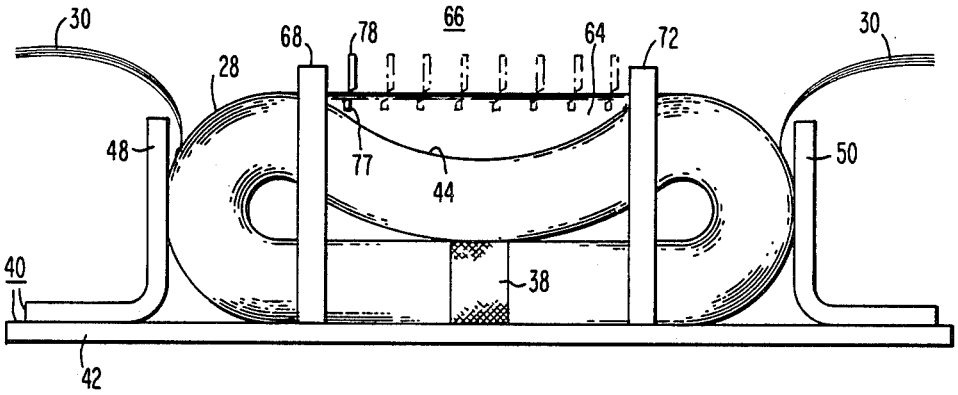
FIG. 8 is an elevational view of the magnetic core shown in FIG. 7, after a plurality of raising and cutting steps, illustrating the perimetrical indexing of either the core loop or the cutting device to create a desired stepped pattern of a core joint which will be subsequently formed.
Figure 10:
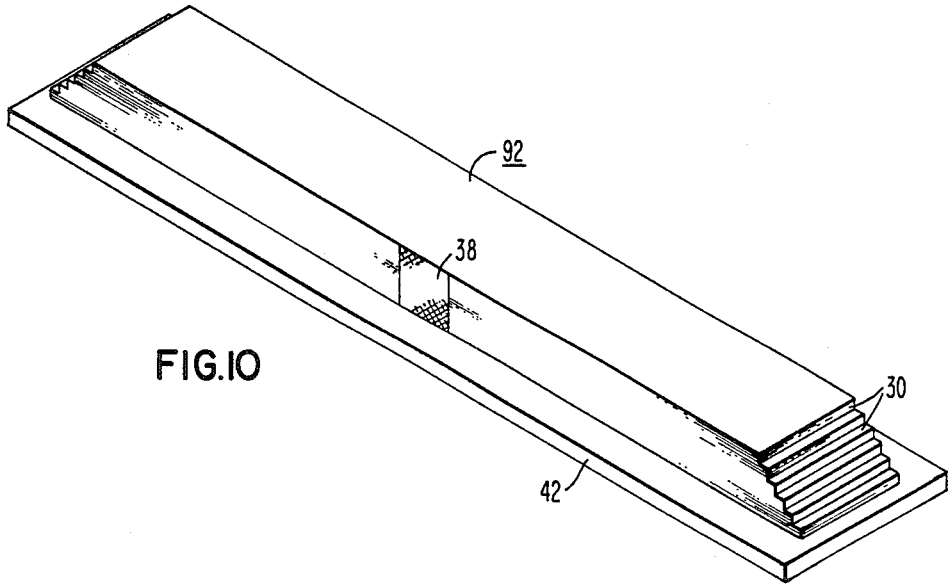
FIG. 10 is a perspective view of the magnetic core shown in FIG. 9 after the raising, cutting and indexing steps have cut the complete core build, with the cut lamination turns all being disposed in a flat stack on the support surface.

As shown in the elevational view of core loop 28 in FIG. 8, either the core loop 28 or the cutting device 66 is indexed in a direction perpendicular to the winding axis 32, along the perimeter of the core loop 28, and above the concave surface 44, as required to provide a predetermined stepped pattern. For example, as shown in FIG. 6, support fixture 40 may be mounted on a carriage 82 which is capable of indexing fixture 40 back and forth, as indicated by double headed arrow 84, and up and down, as indicated by double headed arrow 86. The up and down control may be provided by height control 88, which may have a fiber optic sensor 90, for example. The core loop 28, or the cutting device 66, may be indexed after every cut, after every two cuts, etc., as desired, depending on how many lamination turns 30 are lifted and cut at a time, and depending on how many lamination turns are to be cut along the same plane before the joint pattern is changed. The cutting device 66 is illustrated in eight different positions in FIG. 8, but any number of steps may be used. In a preferred embodiment of the invention, the raising step is arranged to lift and cut about 5 to 10 lamination turns 30 at a time, with the cutting means 66 being indexed after every cut, or after every other cut. The core loop 28, or the cutting means 66, may return to the position of the initial cut, after being indexed through all cutting positions, or it may then "index and cut" in the reverse direction back to the starting position, as desired. FIG. 8 shows the cut lamination turns 30 fanned apart for ease in illustrating the cut turns. FIG. 10 is a perspective view of the cut lamination turns 30 in a stack 92. The purpose of the band 38 of adhesive is more readily apparent in FIG. 10, which illustrates the complete core build being cut into a plurality of stepped patterns, which repeat until all lamination turns 30 have been cut. Band 38 maintains the original positional relationship of every cut lamination turn 30.

Figure 9:
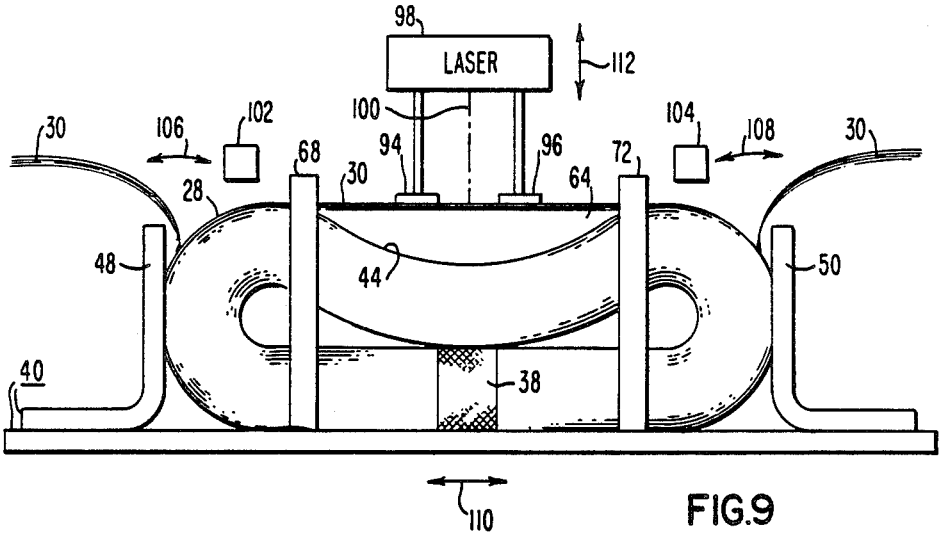
FIG. 9 is an elevational view of the magnetic core shown in either FIG. 5 or 6, illustrating a laser cutting embodiment of the invention.

FIG. 9 is an elevational view of core loop 28 which illustrates a laser beam cutting embodiment of the invention. The magnetic fanning embodiment of FIG. 6 is excellent for laser cutting, as it separates individual lamination turns by magnetic repulsion, enabling one lamination turn at a time to be raised against stops 94 and 96 which are spaced to hold a lamination turn 30 at the focal point of laser beam source 98.

Each time a lamination turn 30 is cut by laser beam 100, suitable means is provided to move the cut ends out of the way. For example, as illustrated in FIG. 9, magnets 102 and 104 may be provided and arranged to attract and move the ends, as indicated by arrows 106 and 108, automatically allowing the next uncut lamination turn 30 to move into cutting position against stops 94 and 96. Thus, even though only one lamination turn is cut at a time, in a preferred laser cutting embodiment, the process is very fast.

After the desired number of lamination turns have been cut at a predetermined location, the cutting location is changed to provide the next "step" of the core joint pattern. This may be accomplished by indexing the core loop 28, indicated by double headed arrow 110, or the laser beam 100 may be indexed. As the cutting steps advance through the core build, the laser source 98 and stops 94 and 96 may be indexed in the direction of laser beam 100, to facilitate lifting each lamination turn 30 to the focal point, with this indexing being indicated by double headed arrow 112; or, alternatively, as disclosed relative to the embodiment of FIG. 6, a fiber-optic height control device may be used to vertically position a carriage upon which the core loop 28 is supported.

Figure 11:
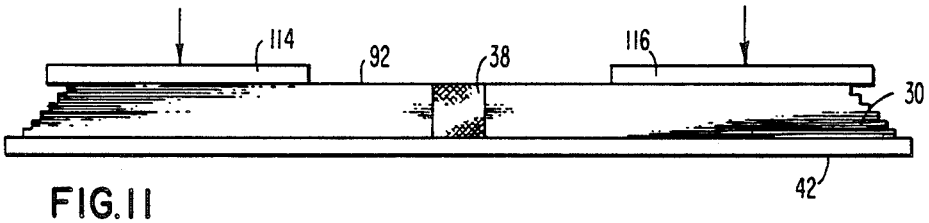
FIG. 11 is an elevational view of the stack of cut lamination turns shown in FIG. 10, illustrating how the stack is clamped prior to a step of turning the stack over.
Figure 12:
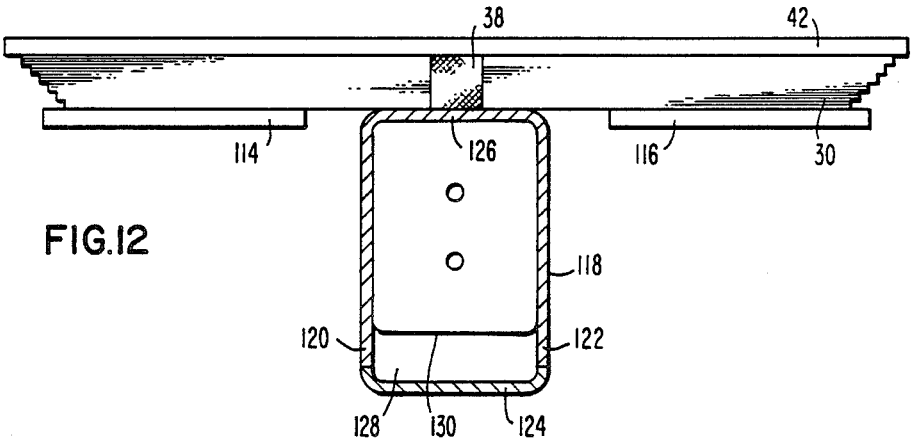
FIG. 12 is an elevational view of the stack of cut lamination turns shown in FIG. 11, after the stack has been turned over and placed into position over a support fixture.

Stack 92 must be turned upside down in the next step of method. This step may be accomplished by a fixture which is rotatable 180 degrees from one vertically oriented position to the other vertical position; or, as illustrated in FIGS. 11 and 12, the stack 92 may be clamped and turned upside down as a unit. FIG. 11 is an elevational view of stack 92 of cut lamination turns 30, clamped between support plate 42 of support fixture 40 and a pair of spaced plate members 114 and 116, to permit the stack 92 to be turned upside down into the orientation of the stack 92 shown in FIG. 12. Stack 92 of cut lamination turns 30 is positioned over a metallic annealing arbor 118. Annealing arbor 118 may be constructed according to the teachings disclosed in copending application Ser. No. 896,782, filed Aug. 15, 1986, in the name of F. Grimes, entitled "Fixture For The Window Of A Magnetic Core", which application is assigned to the same assignee as the present application. Arbor 118 has a rectangularly configured, tubular cross-sectional configuration, including first and second leg portions 120 and 122, respectively, and first and second yoke portions 124 and 126, respectively, which define an opening 128. Stack 92 of cut lamination turns 30, while clamped as shown in FIG. 11, is placed over yoke 126 of arbor 118 with the band 38 of adhesive centrally located relative to yoke portion 126. Plate members 114 and 116 are spaced to allow the stack 92 to directly contact yoke 126 of arbor 118. A suitable support member 130 is inserted into the opening 128 defined by arbor 118. Plate members 114 and 116 are then removed and the cut lamination turns 30 of stack 92 automatically fold or bend to the contour of arbor 118 due to their extreme flexibility, forming a yoke portion 132 which includes the band 38 of adhesive, and first and second leg portions 134 and 136, respectively, adjacent to leg portions 120 and 122, respectively, of arbor 118.

FIG. 14 is an elevational view of the stack 92 of cut lamination turns 30 after the plate members 114 and 116 have been removed. Clamping means 138, which may include an air cylinder, for example, is placed against yoke 132, to tightly clamp the lamination turns 30 together between clamping means 138 and yoke 126 of arbor 118. Then, while pressing the lamination turns 30 tightly together, starting from core yoke 132 and progressing around the corners 140 and 142, additional clamping means 144 and 146, which may be similar to clamping means 138, are utilized to press the lamination turns 30 tightly against leg portions 120 and 122 of arbor 118.

In the clamped configuration shown in FIG. 14, the partially reconstructed core loop is then rotated 180 degrees, such as about lateral axis 148, to the orientation shown in FIG. 15. If a rotatable fixture was used to turn stack 92 upside down, the same fixture may be used to turn the core loop upside down. In such a fixture, support member 130 may be an integral element of the fixture. The ends of the lamination turns 30 are then folded about yoke 124 of arbor 118, to form a core yoke 150 having a joint which defines a stepped pattern 152.

Figure 16:
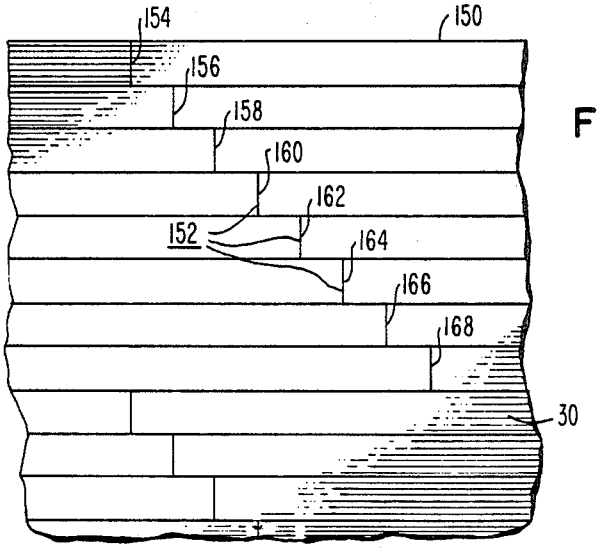
FIG. 16 is a greatly enlarged, fragmentary view, in elevation, of the joint area of the magnetic core shown in FIG. 15.

FIG. 16 is an enlarged fragmentary view of the stepped pattern 152 shown in FIG. 15, setting forth an exemplary stepped-lap pattern which may be used. The stepped-lap pattern 152 may have any desired number of steps in the basic pattern, and any desired dimension from step-to-step. The pattern 152 of the example has eight steps 154, 156, 158, 160, 162, 164, 166, and 168 before it repeats, with each step having a plurality of lamination turns 30, such as 5 to 15, for example. An exemplary dimension from step-to-step is 0.5 inch (12.7 mm). The joint formed at each step is lapped by adjacent lamination turns 30, which accounts for the term "stepped-lap" joint. The resulting rectangularly configured closed loop 170 is then prepared for a stress-relief anneal heat treating step. For example, as shown in FIG. 17, steel plates 171, 173, 175, and 177 may be placed against the outer surfaces of the leg and yoke portions of the core loop 170, and the loop 170, with the support plates in position, may then be tightly banded with a metallic strap or outer wrap 179, to hold the loop 170 tightly closed for the stress-relief anneal step shown in FIG. 17.

FIG. 17 is a cross-sectional view of a furnace or oven 172 having a plurality of rectangularly configured closed magnetic core loops disposed therein, such as the closed core loop 170 shown in FIG. 15. The core loops 170 may have the axes 32 of their openings 128 horizontally oriented, as illustrated, or vertically oriented, as desired. A typical stress relief anneal cycle for amorphous steel of the type suitable for power frequency magnetic cores includes bringing the core loops 170 up to a predetermined temperature, such as 360 to 380 degrees C., while in an inert atmosphere, such as nitrogen, argon, helium, or the like, which atmosphere is provided in the furnace 172 throughout the complete stress-relief anneal cycle. After reaching the predetermined temperature, the cores are held or "soaked" at the predetermined temperature for a predetermined period of time, such as about 2 hours. The cores are then allowed to cool to about 200 degrees C., after which time they may be removed from the protective atmosphere of the furnace 172. A magnetic field may be applied to magnetically saturate the magnetic core loops 170 during selected portions of the stress-relief anneal cycle, as indicated by electrical conductor 174 shown being looped through the core openings or windows 128. A magnetic field of about 10 oersteds has been found to be suitable.

Following the stress-relief anneal heat treating cycle illustrated in FIG. 17, the yoke 150 which includes the stepped joint 152 is firmly clamped together, as shown by clamping members 176 and 178 in FIG. 18. The core loop 170 is then consolidated into a self supporting structure, such as by bonding the closely adjacent edges of the lamination turns 30 which define the axial ends of the core loop. At this point of the method, however, care is taken to prevent any edge bonding of the yoke 150 in which the joint 152 is located. The edge bonded area is indicated in FIG. 18 by the cross-hatched area 180. For example, a UV curable resin, such as disclosed in U.S. Pat. No. 4,481,258, and a fiber glass sheet may be applied to the core area to be bonded, with the UV resin being quickly gelled by UV radiation, before significant penetration of the resin between the lamination turns 30 can occur. Co-pending application Ser. Nos. 699,378 and 716,264, filed Feb. 7, 1985 and March 26, 1985, respectively, which are assigned to the same assignee as the present application, disclose in detail arrangements which may be used to consolidate the magnetic core loop 170.

Magnetic core loop 170 is now ready for assembly with preformed coil assemblies 182 and 184 shown in FIG. 19, with each coil assembly 182 and 184 including high and low voltage winding sections. If magnetic core loop 170 does not have the requisite depth dimension, as measured between the lateral edges of the strip 24 of amorphous metal used to wind the core loop 170, more than one core loop may be used to construct the final core configuration. The windows of any such multiple core loops would be aligned, with the cores placed tightly against one another. A sheet of urethane foam, for example, may be placed between mating core surfaces. The core joint 152 is opened and the unconsolidated laminations of the yoke 150 associated with the joint 152 are extended vertically upward. These unconsolidated lamination portions may be supported within suitable assembly fixtures 186 and 188 to prevent breakage of the laminations, which are now even more brittle following the stress-relief anneal cycle. Coils 182 and 184 may then be telescoped over the upstanding ends of the fixtures 186 and 188, respectively, which enclose the ends of the cut lamination turns, after yoke portion 124 of arbor 118 is removed to permit the coil assemblies to be advanced into the desired positions on the core legs.

FIG. 20 is a fragmentary, perspective view of one of the core legs while still associated with an assembly fixture 186, which illustrates how the upper facing surfaces of the coil assemblies, such as coil assembly 182, may be protected from air borne contamination during subsequent manufacturing steps. An insulating sheet or film 190, such as a sheet of polyethylene, is cut to provide a small opening large enough to enable the sheet 190 to be pulled down snugly over the fixture 186 and the upper facing surface of the coil assembly. Additional small openings may be formed for the electrical leads to project through the protective sheet.

Yoke portion 124 of arbor 118 is the replaced, the stepped-lap joint 152 is reconstructed into exactly the same configuration it occupied during the stress-relief anneal cycle, and the joint area is consolidated, as shown by cross hatched area 192 in FIG. 21. The step of consolidating the yoke 150 and joint 152 may follow the same procedures used to condolidate the core loop 170 as shown in FIG. 18.

FIG. 22 is fragmentary view of magnetic core loop 170 shown in FIG. 21, illustrating an alternative step which may be used for consolidating yoke 150. Instead of consolidating the entire surface of yoke 150, the corners 140 and 142 are consolidated while the area over the stepped-lap joint 152, on one or both sides of the core loop 170, is covered by an insulating sheet member 194, such as a glass cloth, which is not impregnated with a consolidating resin. The edges of the member 194 may be secured to yoke 150 by resin, but the major portion of its surface is unimpregnated, to provide a plurality of small openings which are in communication with the lamination turns of the core loop 170. This construction assures that all of the air will be removed from the core loop during subsequent manufacturing steps and replaced by a suitable insulating dielectric, such as mineral oil.

This completes the method of the invention, resulting in the core-coil assembly 196 shown in FIG. 21 or 22, which may then be processed according to core-coil assemblies of the prior art, to provide a finished electrical transformer.

We claim as our invention:

1. A method of constructing a jointed magnetic core from amorphous metal, comprising the steps of:

winding a strip of amorphous metal to form a closed loop having a plurality of lamination turns disposed about an opening, positioning said closed loop on a support surface in an orientation which allows the inherent flexibility of amorphous metal to collapse the loop opening and form a concave loop in an unsupported portion of the closed loop, raising at least one of the lamination turns away from the concave loop to provide a clearance between the at least one raised lamination turn and the remaining portion of the the concave loop, cutting said at least one raised lamination turn, and repeating the raising and cutting steps until all of the lamination turns have been cut.

2. The method of claim 1 wherein the step of cutting the at least one lamination turn includes the step of indexing the locations of at least certain of the cuts to provide a predetermined stepped pattern.

3. The method of claim 1 including the step of fixing the lamination turns together at a predetermined perimetrical location of the closed loop, to maintain the as-wound positional relationship of the lamination turns, prior to the step of cutting the lamination turns.

4. The method of claim 3 wherein the step of fixing the lamination turns includes the step of applying an adhesive in a narrow band across the edges of the lamination turns, to bond the lamination turns together.

5. The method of claim 3 wherein the step of positioning the closed loop on a support surface, positions the closed loop such that the fixed perimetrical location of the core loop is in the portion of the core loop directly supported by the support surface.

6. The method of claim 1 wherein the step of raising a plurality of lamination turns away from the concave loop includes the step of applying a magnetic field to the lamination turns in the concave loop.

7. The method of claim 6 wherein the step of applying a magnetic field to the lamination turns in the concave loop includes positioning the magnetic field to magnetically lift a plurality of lamination turns by magnetic attraction between the source of the magnetic field and the lifted lamination turns.

8. The method of claim 6 wherein the step of applying a magnetic field to the lamination turns in the concave loop includes the step of positioning the magnetic field to magnetically fan the lamination turns by magnetic repulsion.

9. The method of claim 8 wherein the step of positioning the magnetic field includes the step of placing magnets of like polarity on opposite sides of the closed loop, adjacent to the edges of the lamination turns.

10. The method of claim 1 wherein the winding step includes the step of winding the strip of amorphous metal on a mandrel having a round cross sectional configuration.

11. The method of claim 1 including the step of moving the ends of the lamination turns, after they have been cut, away from the core loop.

12. The method of claim 11 wherein the step of moving the ends of the lamination turns, after they have been cut, includes the step of applying a magnetic field to the cut ends.

13. The method of claim 1 wherein the step of raising at least one lamination turn raises a plurality of lamination turns, and the cutting step includes the step of providing lamination cutting means, advancing the lamination cutting means into a cutting position after each step of raising a plurality of lamination turns, and retracting the lamination cutting means after each cutting step, to prevent interference between the cutting means and the step of lifting lamination turns.

14. The method of claim 13 including the step of indexing the cutting location after predetermined cutting steps, to provide a predetermined stepped pattern.

15. The method of claim 14 wherein the step of indexing the cutting location provides a stepped pattern having a predetermined number of steps, and then repeats the stepped pattern.

16. The method of claim 13 wherein the step of raising a plurality of lamination turns raises and fans the raised lamination turns apart, with the step of advancing the lamination cutting means into the cutting position automatically selecting those lamination turns for simultaneous cutting which have been raised above a predetermined elevation.

17. The method of claim 1 wherein the winding step includes the step of providing a winding mandrel having an external winding tube separable from the winding mandrel, winding the strip of amorphous metal about the assembled mandrel and tube, and removing the tube after the winding step such that the tube maintains the loop opening.

18. The method of claim 17 including the steps of providing a perimetrical gap in the winding tube after the step of winding the strip of amorphous material, flattening the loop adjacent to said perimetrical gap, applying an adhesive to the edges of the lamination turns in the flattened portion of the closed loop, to maintain the as-wound positional relationship of the lamination turns, prior to the step of cutting the lamination turns, and removing the winding tube after the lamination turns have been positionally fixed.

19. The method of claim 1 including the steps of:

fixing the lamination turns together at a predetermined perimetrical location of the closed loop, to maintain the as-wound positional relationship of the lamination turns, prior to the step of cutting the lamination turns, turning the laminations over after all of the lamination turns have been cut and disposed in a stack, placing the stack of laminations on a core support fixture while allowing the ends of the laminations to droop about opposite sides of the core support fixture, wrapping the laminations about the core support fixture, closing the joint about the core support fixture, to provide a closed loop with a joint, stress relief annealing the closed loop with the joint, while it is supported by the core support fixture, and consolidating the lamination turns of the closed loop after the stress relief annealing step, except adjacent to the joint, to allow the joint to be opened to receive electrical windings without disturbing the remainder of the core loop.

20. The method of claim 19 including the steps of:

opening the joint in the closed loop, after the consolidating step, assembling electrical coils on portions of the opened loop, closing the joint, and consolidating the area of the joint after it has been closed.

21. The method of claim 19 wherein the step of consolidating the magentic core loop, except in the area of the joint, includes the step of edge bonding the edges of the lamination turns with an adhesive.

22. The method of claim 20 wherein the step of consolidating the area of the joint, after it has been closed, includes the step of edge bonding the edges of the lamination turns with an adhesive.

23. The method of claim 1 wherein the raising step raises a plurality of lamination turns and the cutting step cuts a plurality of the raised lamination turns simultaneously.

24. The method of claim 13 including the step of indexing the cutting location after certain of the cutting steps, to provide a predetermined stepped pattern.

25. The method of claim 20 wherein the step of consolidating the area of the joint after it has been closed includes the step of providing openings in communication with the lamination turns to enable air to be withdrawn from the core loop.

26. The method of claim 20 wherein the step of opening the joint in the closed loop includes the steps of extending the ends of the opened core loop perpendicularly upward, and assembling a guide fixture about each of said extended ends to facilitate the step of assembling electrical coils on portions of the open core loop.

27. The method of claim 26 including the step of drawing an insulating sheet snugly over each of the guide fixtures and over at least a predetermined portion of the electrical coils, to protect the electrical coils from air borne contaminants.

28. The method of claim 1 wherein the cutting step includes the step of providing laser cutting means, and the step of cutting the at least one raised lamination turn uses said laser cutting means.

29. The method of claim 1 wherein the laser cutting means has a predetermined focal point, and the raising step raises the at least one lamination turn to the focal point.

30. The method of claim 11 wherein the step of moving the ends of the lamination turns, after they have been cut, includes the step of applying air to the cut ends.

31. The method of claim 1 including the step of raising the closed loop as required, to maintain the at least one raised lamination turn at a predetermined position for the cutting step.

32. The method of claim 1 wherein the cutting step includes the step of providing cutting means having first and second blades, each having first and second ends, and including the steps of pivoting the first blade relative to the second blade adjacent said first ends, while biasing the first end of the first blade against first end of the second blade.

33. The method of claim 32 wherein the cutting step includes the steps of advancing the cutting means into a cutting position, guiding the second end of the second blade into a fixed guide as the cutting means advances, applying a force to the second end of the first blade while simultaneously biasing the second end of the first blade against the second end of the second blade.

* * * * *